US006270850B1

(12) United States Patent
Cai et al.

(10) Patent No.: US 6,270,850 B1
(45) Date of Patent: Aug. 7, 2001

(54) METHOD TO IMPROVE DIP COATING

(75) Inventors: Jian Cai, Penfield; Huoy-Jen Yuh, Pittsford; Merlin E. Scharfe, Penfield; Robert F. Dunham, Walworth, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/329,678

(22) Filed: Jun. 10, 1999

(51) Int. Cl.[7] ..... B05D 1/18

(52) U.S. Cl. ..... 427/430.1; 427/435; 427/8; 427/9

(58) Field of Search ..... 427/430.1, 435, 427/8, 9; 118/423, 429, 400

(56) References Cited

U.S. PATENT DOCUMENTS 5,578,410 11/1996 Petropoulos et al. ..... 430/133
5,612,092 3/1997 Strenger et al. ..... 427/356
5,633,046 5/1997 Petropoulos et al. ..... 427/430.1
5,681,391 10/1997 Mistrater et al. ..... 118/400
5,693,372 12/1997 Mistrater et al. ..... 427/430.1

*Primary Examiner*—Katherine A. Bareford
(74) *Attorney, Agent, or Firm*—Zosan S. Soong

(57) ABSTRACT

A method for improving the quality of a dip coated layer that is deposited by flowing a solution along a substrate in a gap between the substrate and a wall, including: (a) determining a yield stress, a viscosity, a density, and a surface tension of the solution, and selecting a wet thickness of the coated layer; (b) determining a coating speed based on the determined viscosity, the determined density, the determined surface tension of the solution, and the selected wet layer thickness; and (c) selecting a distance for the gap and calculating the shear stress of the solution in the gap based on the gap distance, wherein the shear stress is greater than the yield stress.

8 Claims, No Drawings

METHOD TO IMPROVE DIP COATING

FIELD OF THE INVENTION

This invention relates to dip coating, particularly to the dip coating employed during the fabrication of photoreceptors.

BACKGROUND OF THE INVENTION

High print quality of xerographic reproductions is desired. The print quality depends strongly on the photoreceptor coating quality. For coating from a solution, the coating thickness uniformity depends on how the coating conditions have been optimized with the rheological and interfacial properties of the solution. Solutions containing solvent, monomers, polymers, and/or pigments are often used for coating. Many of the solutions change their rheological properties or microscopic structures (especially for pigment dispersions) under shear deformation. It is therefore important to design a coating method to accommodate such change under shear deformation to achieve the required coating uniformity. For dip coating, the coating vessel or tank design is important to obtain good coating quality. The detailed design of the geometry and size of the vessel and the accessories such as the atttached piping and the pump determines the solution flow pattern which can affect the final coating quality especially for non-Newtonian solutions. Newtonian flow is flow of a liquid having a constant viscosity under shear deformation. Viscosity of non-Newtonian liquid may decrease or increase with increasing shear deformation or shear rate, i.e., so-called shear thinning or shear-thickening.

Ideally, the use of Newtonian solutions for coating can avoid a lot of coating problems, but practically it is difficult to develop such solutions which must also satisfy other performance requirements such as xerographic properties. Most of the time, non-Newtonian solutions must be used for coating. However, such non-Newtonian solutions with all the required performance properties may not be ideal for coating. Many of them change in viscosity upon the application of shear and the dispersed particles in some solutions aggregrate and settle at low shear rates. Often the solutions have yield stress, below which the dispersion shows little or no deformation, i.e., little or no flow. Newtonian flow does not have a yield stress. Liquid with a yield stress is one type of a non-Newtonian liquid. Some non-Newtonian liquids do not have yield stress. At very low yield stress or low shear rate level, the viscosity reaches extremely high levels. It has been observed that a non-Newtonian dispersion with shear thinning, yield stress, and flocculating properties can cause coating non-uniformities such as streaking, marbling, and sloping (that is, a top to bottom thickness difference on a drum).

The present invention addresses the above stated problem with non-Newtonian solutions by providing a method to select the appropriate gap distance employed between the substrate and the dip coating vessel wherein the selected gap distance will minimize or eliminate coating non-uniformities.

Dip coating methods and apparatus are disclosed in Mistrater et al., U.S. Pat. No. 5,693,372; Mistrater et al., U.S. Pat. No. 5,681,391; Petropoulos et al., U.S. Pat. No. 5,578,410; and Petropoulos et al., U.S. Pat. No. 5,633,046, the disclosures of which are totally incorporated herein by reference.

In addition, application Ser. No. 09/182,087, having the inventor Jian Cai, discloses an extrusion coating process where there is maintained an applied shear stress to the coating composition that is greater than the yield stress of the coating composition.

SUMMARY OF THE INVENTION

The present invention is accomplished in embodiments by providing a method for improving the quality of a dip coated layer that is deposited by flowing a solution along a substrate in a gap between the substrate and a wall, comprising:

(a) determining a yield stress, a viscosity, a density, and a surface tension of the solution, and selecting a wet thickness of the coated layer;

(b) determining a coating speed based on the determined viscosity, the determined density, the determined surface tension of the solution, and the selected wet layer thickness; and (c) selecting a distance for the gap and calculating the shear stress of the solution in the gap based on the gap distance, wherein the shear stress is greater than the yield stress.

DETAILED DESCRIPTION

The dip coating method may be accomplished in various ways, all of which are encompassed by the present invention. For example, the substrate may be lowered into the solution and the substrate is then raised from the solution. Also, raising and lowering of the coating vessel containing the solution to coat a stationary substrate can constitute dip coating. In another technique, pumping the solution into the vessel to contact the substrate (corresponding to lowering the substrate into the solution) and then removing the solution from the vessel (corresponding to raising the substrate from the solution) can constitute dip coating.

As explained herein, there is a gap between the substrate and a wall during dip coating. The wall may be the inner surface of a coating vessel. In embodiments, an insert is disposed inside the coating vessel where the insert is spaced from and adjacent the substrate; the wall then is the surface of the insert adjacent the substrate. The optional insert may be annularly shaped so that it surrounds the substrate. The coating vessel may be cylindrically shaped. The surfaces of the wall and the substrate may be parallel to each other.

The solution, such as dispersions of organic photoconductive pigment particles in a solution of film forming binder material, may show little or no deformation up to a certain threshold value of the applied finite shear stress. This threshold value is defined as the "yield stress." For non-thixotropic solutions, the yield stress is "substantially constant" over several measurement cycles. For thixotropic solutions, the yield stress may increase if the same solution is under shear for several measurement cycles due to changes in the flocculates or aggregation structure, i.e., varies due to slight non-uniformities in dispersion concentration in different locations of the solution. When the applied shear stress exceeds this yield stress, the solution flows readily. The shear stress and yield stress are measured in "Pascal" or "dyne per square centimeter" units from most rheometers. The yield stress for any specific solution can be measured by a stress rheometer with a double Couette geometry. A typical stress rheometer is Stress Tech, available from ATS RheoSystems. To determine yield stress, one should measure for example five times. For non-thixotropic solutions, the yield stress is "substantially constant" for the five measurements. For thixotropic solutions, one can measure as many times as needed until two consecutive measurements are "substantially constant."

Generally, for dispersions of organic photoconductive pigment particles in a solution of film forming binder material, the application of high shear stress to the coating material causes the material to flow faster, but the yield stress remains substantially unchanged for any given dispersion of organic photoconductive pigment particles in a solution of film forming binder material. The expression "substantially unchanged" or "substantially constant" as employed herein is defined as varying less than about ±20 percent of the mean yield stress in Pascal units. Some dispersions of organic photoconductive pigment particles in a solution of film forming binder material are thixotropic. Thixotropic dispersions are time dependent and, therefore, the yield stress of thixotropic dispersions changes with time. Thus, for example, the yield stress of a thixotropic dispersion may have a Pascal value of 0.26 when subjected to shear stress on one occasion and can have a yield stress value of 0.42 Pascal when subjected to shear stress on the next occasion. Dispersions of organic photoconductive pigment particles in a solution of film forming binder material typically show little or no variation in yield stress when subjected to shear stress applied on different occasions. Thus, for example the yield stress of a dispersion of benzimidazole perylene particles in a solution of a film forming binder is between about 0.2 and about 0.6 Pascal. Although the yield stress of a dispersion of organic photoconductive particles changes with changes in the particle size and changes in the proportion of components (particles, binder and solvent), the yield stress of a specific given dispersion changes very little from one moment in time to another much later point in time. The yield stress and shear stress for a given composition may be determined by any suitable technique. A typical technique involves the use of a stress rheometer.

Thus, to minimize or prevent coating defects in the deposited layer, the calculated shear stress of the solution in the gap during dip coating must be greater than the solution's yield stress. Preferably, the shear stress in the flow field is at least about 0.5 Pascal greater than the yield stress of the solution. In embodiments, the shear stress is greater than the yield stress of the solution by an amount ranging from about 0.5 to about 2 Pascal.

Satisfactory results are achieved with a shear stress of at least about 100 percent greater than the yield stress. Preferably, the shear stress is between about 30 and about 80 percent greater than the yield stress. By maintaining the shear stress higher than the yield stress, improved uniformity of the deposited coating is obtained and defects along the edges of the deposited coating are also avoided. The coated layer uniformity is very important to the imaging quality capabilities of the final photoreceptor. Uniformity of the coated layer is in the sense that there is absent streaking, marbling, and sloping.

Generally, lower solution viscosities tend to form thinner wet coatings whereas solutions having high viscosities tend to form thicker wet coatings. Obviously, the thickness of a wet coating will be greater than the thickness of a dried coating.

Coating thickness uniformity is very sensitive to the power law index n. The power law model is the most widely used form of the general viscous constitutive relation. The power law index n characterizes shear thinning of the solution. When n=1, the solution is a Newtonian liquid, the viscosity is a constant. When n is smaller than 1, the solution is shear thinning, i.e., the viscosity of the solution decreases with increasing shear rate.

Any suitable temperature may be employed in the coating deposition process. Generally, ambient temperatures are preferred for deposition of solution coatings. However, higher temperatures may be desirable to facilitate more rapid drying of deposited coatings.

The various steps employed in the present method may be in any suitable sequence.

To determine a yield stress and thixotropy of the solution, a stress rheometer with a method of Couette flow can be used. The yield stress of the solution may range for example from about 0 to 0.8 Pascal for a dispersion of a charge generating layer.

To determine viscosity of a solution, a rheometer with various methods, e.g., Couette flow, Cone and plater, and parallel disks, can be used. The preferred method is Couette flow. The solution viscosity may range for example from about 2 centipoise to 100 Pascal.sec (at very low shear rate).

In selecting the wet thickness of the coated layer, one considers the purpose of the coated layer. For example, if the layer is a charge generating layer, the thickness typically will be much thinner than if the layer is a charge transport layer. The wet thickness of the coated layer may range for example from about 2 to about 60 micrometers, preferably from about 2 to about 30 micrometers.

The density of the solution may range for example from about 1 to about 1.5 g/cc.

The surface tension may be determined by the Wilhelmy plate method. The surface tension of the solution may range for example from about 20 to about 40 dyne/cm.

In determining a coating speed based on the solution's viscosity, density, and surface tension, and the wet coated layer thickness, a simple equation can be used:

$$h = c_1\sqrt{\frac{\mu U}{\rho g}}$$

where h is a wet thickness, $\mu$ viscosity, U coating speed, $\rho$ density, g gravitational acceleration, and $c_1$ a proportionality constant, which is around 0.8 for Newtonian liquids. One can determine the proportionality constant $c_1$ by trial and error from experiments using various wet coated layer thicknesses.

The coating speed at which the layer is deposited on the substrate may range for example from about 50 to about 1500 mm/minute, preferably about 100 to about 500 mm/minute, based on the dip coating techniques disclosed herein such as raising the substrate out of the solution, lowering the vessel from the solution, or pumping the solution out of the vessel. The coating speed may be constant or varied depending on the desired layer thickness profile (that is, the layer may have a uniform thickness or a tapered thickness along the length of the substrate).

In selecting a distance for the gap and calculating the shear stress of the solution in the gap based on the gap distance, wherein the shear stress is greater than the yield stress, the following equation(s) may be used:

The continuity equation for an incompressible fluid, $\Delta\cdot v=0$, where v is a velocity vector.

The equation of motion that governs the conservation of momentum, $$Re\ v\cdot\Delta v=\Delta\cdot\tau-\Delta p+Stg,$$

where $\tau$ is an extra stress tensor, p the pressure, g the acceleration of gravity (whereas g is the unit vector in the direction of gravity), $Re=\rho LU/\mu$ is the Reynolds number which is a ratio of inertial force and net viscous force, and $St \equiv \tau g L^2/\mu U$ the Stokes number which is a ratio of gravity force and net viscous force, U is a characteristic velocity, e.g., substrate moving speed, L a characteristic length, e.g., gap between the substrate and wall of the coating tank, ρ density and $\mu$ viscosity.

The constitutive equation, e.g., the Bingham model, $$j=0 \text{ for } \tau<\tau_y \text{ and } \tau=\mu j+\tau_y \text{ for } \tau \geqq \tau_y,$$

where $\tau_y$ is yield stress.

And boundary conditions, the traction boundary condition at the liquid/gas interface or free surface is the force balance with traction, $$n \cdot T = \frac{1}{Ca}\frac{dt}{ds} - p_a n;$$

the boundary condition of no mass transfer through a free surface $n \cdot v=0$; along the solid surfaces, the liquid sticks to stationary walls or a substrate that moves, no-slip boundary is $v=v_s$, where T is total stress tensor, $Ca \equiv \mu U/\sigma$ the capillary number, σ the surface tension, $p_a$ the ambient pressure, $v_S$ the velocity of solid boundaries, n the local unit normal to the boundary, t the local unit tangent, and s the arc length along the boundary. The curvature of the boundary is then dt/ds. The system equations are solved by a standard procedure for solving a typical computational fluid mechanics of a free surface flow.

The gap distance may range for example from about 2 to about 20 mm, preferably from about 2 to about 9 mm. The gap distance is measured by a straight line that is perpendicular to both the substrate surface and the wall. Where both the substrate and the coating vessel are cylindrically shaped (with no insert), the gap distance is measured along an imaginary radius line between the outer surface of the substrate and the inner surface of the vessel.

Please note that the equations discussed in conjunction with calculating the coating speed and the gap distance are known equations and may be found in the following sources: R. Byron Bird et al., "Dynamics of Polymeric Liquids, Volume 1 Fluid Mechanics," (2ed. 1987); R. Byron Bird et al., "Transport Phenomena," (1960); and L. E. Scriven, "Physics And Applications of Dip Coating And Spin Coating," Materials Research Society Symposium Proceedings, Volume 121 (1988), the disclosures of which are totally incorporated by reference.

The solution may be a dispersion for a charge generating layer. In other embodiments, the solution can be any solution with a non-zero yield stress, e.g., some paints.

The solution may be a charge generating composition composed of finely divided photoconductive organic or inorganic particles dispersed in a solution of a film forming polymer dissolved in a liquid solvent for the polymer. If desired, the process of this invention can be used to form a single layer photoreceptor, i.e., one that comprises charge generating particles, film forming polymer and charge transport material in a single layer that can be used without a separate charge transport layer. The single layer photoreceptor coating composition should be composed of a dispersion of charge generating particles, charge transport particles, and film forming polymer dissolved in a solvent, the dispersion having a substantially constant yield stress.

Any suitable organic photoconductive particles may be utilized in the coating dispersions. The organic photoconductive particles useful in the process of this invention are pigments which form a dispersion in a solution of a film forming binder dissolved in a liquid solvent, the dispersion having a measurable substantially constant yield stress. The yield stress is considered measurable when the value is at least about 0.06 Pa with the current state-of-art rheometer. Typical organic photoconductive particles include, for example, various phthalocyanine pigments such as the X-form of metal free phthalocyanine, metal phthalocyanines such as hydroxy gallium phthalocyanine, titanyl phthalocyanine, vanadyl phthalocyanine and copper phthalocyanine; perylenes such as benzimidazole perylene; quinacridones; dibromo anthanthrone pigments; substituted 2,4-diamino-triazines; polynuclear aromatic quinones; and the like and mixtures thereof. Generally, the organic photoconductive pigment particles have an average particle size between about 0.2 micrometer and about 0.4 micrometer.

The yield stress of a typical benzimidazole perylene coating composition is between about 0.2 and about 0.6 Pascal. The shear thinning value for a benzimidazole coating composition dispersion is between about 0.4 and about 0.85 Power Law Index. The expression "shear thinning" as employed herein is defined as the shear viscosity decreasing with increasing shear rate. The expression "Power Law Index" is described above.

Any suitable film forming polymer soluble in a solvent may be employed in the solution used in the process of this invention. Typical film forming polymers include, for example, polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like.

Any suitable solvent may be utilized to dissolve the film forming polymer and form the coating dispersion. The solvent should not dissolve the organic photoconductive pigment particles and should be a solvent for the film forming binder. Typical solvents include, for example, methylene chloride, tetrahydrofuran, toluene, methyl ethyl ketone, isopropanol, methanol, cyclohexanone, heptane, other chlorinated solvents, and the like.

Any suitable proportion of organic photoconductive pigment particles, solvent and film forming binder may be employed to form the dispersion. Typical weight portions include about 1.4 to about 2 percent by weight organic photoconductive pigment particles, about 93 to about 94 percent by weight solvent and about 3.5 to about 5 percent by weight film forming binder, based on the total weight of the dispersion. The organic photoconductive, i.e. charge generation, particles can be present in the film forming binder of the final dried coating in various amounts. Generally, from about 5 percent by volume to about 90 percent by volume of the organic photoconductive is dispersed in about 10 percent by volume to about 95 percent by volume of the film forming binder, and preferably from about 20 percent by volume to about 30 percent by volume of the organic photoconductive is dispersed in about 70 percent by volume to about 80 percent by volume of the film forming binder. The final dried charge generating layer generally ranges in thickness of from about 0.1 to about 5 micrometers, and preferably has a thickness of from about 0.3 to about 3 micrometers. The charge generation layer thickness is related to film forming polymer content. Higher film forming polymer content compositions generally require thicker layers for photogeneration. Thicknesses outside these ranges can be selected providing the objectives of the present invention are achieved. Drying of the deposited coating may be effected by any suitable conventional technique such as oven drying, infra red radiation drying, air drying and the like.

The dip coating method may be employed to coat the surface of substrates of various configurations including webs, sheets, plates, cylinders, and the like. The substrate may be flexible, rigid, uncoated, precoated, as desired. The substrate may comprise a single layer or be made up of multiple layers. The substrate may be insulating or conductive and, if desired, precoated with layers such as conductive layers, adhesive layers, charge blocking layers and the like. These layers are conventional and well known in the art of electrostatography and described for example in U.S. Pat. Nos. 4,265,990 and 4,439,507, the entire disclosures of these patents being incorporated herein by reference.

A charge transport layer may be deposited on the charge generating layer or, alternatively, the charge transport layer may be formed on the substrate prior to application of the charge generating layer. The charge transport layer may comprise any suitable transparent organic polymer or non-polymeric material capable of supporting the injection of photogenerated holes and electrons from the charge generating layer and allowing the transport of these holes or electrons through the transport layer to selectively discharge the surface charge. The active charge transport layer not only serves to transport holes or electrons, but also protects the charge generation layer from abrasion or chemical attack and therefore extends the operating life of the photoreceptor imaging member. The charge transport layer should exhibit negligible, if any, discharge when exposed to a wavelength of light useful in the electrostatographic process for which the photoreceptor is employed. Therefore, the charge transport layer is substantially transparent to radiation in a region in which the photoconductor is to be used. Thus, the active charge transport layer is a substantially non-photoconductive material which supports the injection of photogenerated holes from the generation layer. The charge transport layer in conjunction with the generation layer is a material which is an insulator to the extent that an electrostatic charge placed on the transport layer is not conducted in the absence of illumination.

The active charge transport layer may comprise any suitable activating compound useful as an additive dispersed in electrically inactive polymeric materials making these materials electrically active. These compounds may be added to polymeric materials which are incapable of supporting the injection of photogenerated holes from the generation layer and incapable of allowing the transport of these holes therethrough. This will convert the electrically inactive polymeric material to a material capable of supporting the injection of photogenerated holes from the generation layer and capable of allowing the transport of these holes through the active layer in order to discharge the surface charge on the active layer.

The charge transport layer forming mixture preferably comprises an aromatic amine compound. An especially preferred charge transport layer employed in one of the two electrically operative layers in a multilayer-layer photoconductor is composed of from about 35 percent to about 45 percent by weight of at least one charge transporting aromatic amine compound, and about 65 percent to about 55 percent by weight of a polymeric film forming resin in which the aromatic amine is soluble. The substituents should be free form electron withdrawing groups such as $NO_2$ groups, CN groups, and the like. Typical aromatic amine compounds include, for example, triphenylmethane, bis(4-diethylamine-2-methylphenyl)phenylmethane; 4'-4"-bis(diethylamino)-2', 2"-dimethyltriphenylmethane, N,N'-bis(alkylphenyl)-(1,1'-biphenyl)-4,4'-diamine wherein the alkyl is, for example, methyl, ethyl, propyl, n-butyl, etc., N,N'-diphenyl-N,N'-bis(chlorophenyl)-(1,1'-biphenyl)-4,4'-diamine, 1,1'-biphenyl)-4,4'-diamine, and the like dispersed in an inactive resin binder.

Any suitable inactive resin binder soluble in methylene chloride, chlorobenzene or other suitable solvent may be employed. Typical inactive resin binders include polycarbonate resin, polyvinylcarbazole, polyester, polyarylate, polyacrylate, polyether, polysulfone, and the like.

Any suitable and conventional technique may be utilized to mix and thereafter apply the charge transport layer coating mixture to the charge generation layer. Typical application techniques include spraying, dip coating, roil coating, wire wound rod coating, and the like. Drying of the deposited coating may be effected by any suitable conventional technique such as oven drying, infra red radiation drying, air drying and the like. Generally, the thickness of the transport layer is between about 5 micrometers and about 100 micrometers, but thicknesses outside this range can also be used provided that there are no adverse effects.

Other layers such as conventional ground strip layers, overcoating layers and anticurl backing layers may also be applied to the photoreceptor, if desired.

Thus, the process of this invention provides an improved process for dip coating of solutions to form a dried coating having a uniform thickness with fewer defects. Also, the process of this invention forms a photoreceptor which does not produce undesirable artifacts in the final electrophotographic copy.

Thus, by selecting the appropriate gap distance for a given set of dip coating parameters, the present invention ensures a sufficient shear rate that breaks up flocculates, minimizes vortices and stagnation areas in solutions during the coating process, especially unstable (in the rheological sense), non-Newtonian solutions.

Other modifications of the present invention may occur to those skilled in the art based upon a reading of the present disclosure and these modifications are intended to be included within the scope of the present invention.

We claim:

1. A method for improving the quality of a dip coated layer that is deposited by flowing a solution along a substrate in a gap between the substrate and a wall, comprising:

(a) determining a yield stress, a viscosity, and a density of the solution, and selecting a wet thickness of the coated layer;

(b) determining a coating speed U according to the equation:

$$h = c_1\sqrt{\frac{\mu U}{\rho g}}$$

where $\mu$ is the determined viscosity, ρ is the determined density, h is the selected wet layer thickness, g is the gravitational acceleration, and $c_1$ is a proportionality constant;

(c) selecting a distance for the gap, which is the distance between the substrate and the wall, and calculating the shear stress of the solution in the gap based on the selected gap distance and the determined coating speed, wherein the shear stress is greater than the yield stress; and (d) flowing the solution along the substrate in the gap between the substrate and the wall at the selected gap distance and at the determined coating speed to form the dip coated layer.

2. The method of claim 1, wherein the solution is a charge generating composition.

3. The method of claim 1 wherein the solution is a charge transport composition.

4. The method of claim 1, wherein the gap distance ranges from about 2 to about 20 mm.

5. The method of claim 1, wherein the gap distance ranges from about 2 to about 9 mm.

6. The method of claim 1, wherein the selected wet thickness of the coated layer ranges from about 2 to about 30 micrometers.

7. The method of claim 1, wherein the shear stress is at least about 0.5 Pascal greater than the yield stress.

8. The method of claim 1, wherein the coating speed ranges from about 50 to about 1500 mm/minute.

* * * * *